United States Patent [19]

Whitaker

[11] 4,045,848

[45] Sept. 6, 1977

[54] METHOD OF PRODUCING A WARP OF INTERMITTENTLY COLORED YARNS

[75] Inventor: Ralph Whitaker, Bala-Cynwyd, Pa.

[73] Assignee: Fred Whitaker Company, Bala-Cynwyd, Pa.

[21] Appl. No.: 724,335

[22] Filed: Sept. 17, 1976

Related U.S. Application Data

[63] Continuation of Ser. No. 622,016, Oct. 14, 1975, abandoned.

[51] Int. Cl.[2] ..... D02G 1/00

[52] U.S. Cl. ..... 28/218; 28/168

[58] Field of Search ..... 28/72.16, 72.6, 76 T, 28/218

[56] References Cited

U.S. PATENT DOCUMENTS

| | | | |
|---|---|---|---|
| 2,147,736 | 2/1939 | Dreyfus | 28/76 T |
| 2,857,651 | 10/1958 | Keen | 28/72.16 |
| 3,102,322 | 9/1963 | Whitaker | 28/72.16 |
| 3,343,242 | 9/1967 | De Witte | 28/72.6 |
| 3,401,467 | 9/1968 | Koester | 28/76 T X |
| 3,466,718 | 9/1969 | Adamson | 28/72.16 |
| 3,605,225 | 9/1971 | Gibson et al. | 28/72.16 |

FOREIGN PATENT DOCUMENTS

| | | | |
|---|---|---|---|
| 2,007,285 | 9/1971 | Germany | 28/72.16 |

*Primary Examiner*—Robert R. Mackey
*Attorney, Agent, or Firm*—Miller & Prestia

[57] ABSTRACT

Synthetic continuous filament yarn is woven with a sacrificial filling and thus formed into a prefabric, selected portions of the prefabric are dyed, the prefabric is optionally crimped either before or after dyeing, the prefabric is immersed into a dilute solution which, when concentrated will destroy the sacrificial filling, and the prefabric is then conducted through a heating and drying operation, boiling off the water and concentrating the solution, then substantially completely destroying the sacrificial filling and freeing the warp yarns as a free warp of intermittently colored yarns.

3 Claims, 4 Drawing Figures

METHOD OF PRODUCING A WARP OF INTERMITTENTLY COLORED YARNS

This is a continuation of application Ser. No. 622,016 filed Oct. 14, 1975, now abandoned.

BRIEF DESCRIPTION OF THE INVENTION

The method of this invention produces a novel form of intermittently colored continuous filament synthetic polymeric yarns, arranged as a warp. Sequential portions of yarn are dyed in different colors, and some portions may be left undyed. Each yarn consists of random, intermittent dyed or undyed lengths consisting of at least two different colors intermittently and randomly arranged along the length of the yarn.

In accordance with this invention, such yarn is produced as a warp comprising a large number of yarns arranged in parallel and spaced apart from each other. Such a warp is well adapted to be formed into a tufted pile carpet having a base to which are anchored a plurality of upstanding piles of yarn, which tufts have colors that are randomly arranged in an attractive manner, and free of the streakiness that is sometimes encountered in carpets when the yarns are not "spacedyed".

BACKGROUND OF THE INVENTION

This invention relates to a novel method of making an intermittently dyed yarn, and has particular reference to a method of making multicolored yarns in the form of a warp which is particularly suitable for the production of tufted pile carpets.

In the production of carpets composed of the well known spacedyed yarns, such as yarns produced in accordance with my issued U.S. Pat. No. 3,012,303, granted Dec. 12, 1961 and my U.S. Pat. No. 3,102,322, granted Sept. 3, 1963, it has been conventional to form the drawn and crimped continuous filament yarn into a prefabric such as knitted tubing, for example, and to pad dye the tubing with an overall basic color. This was followed by spacedyeing in which selected areas of the tubing were printed with different colors, following which the prefabric was dyed and the dye was heat-set. It was then necessary to deknit each individual prefabric, producing only a single end of yarn. Such single end was either wound into a single package or combined with other single ends from other prefabrics to form a warp. Thereafter, the yarn was subjected to a carpet tufting operation in order to produce a multicolored tufted carpet. This, of course, is a complicated and laborious operation.

It is accordingly an object of this invention to provide a method which avoids the need to knit and later to deknit individual ends of yarn. It is another object to provide a method of making a multiplicity of yarns from a single prefabric, which yarns are spacedyed and are ideally adapted for production of carpet with drastically reduced cost.

It is still another object of this invention to provide a carpet making method which utilizes less floor space in the mill and which is integrated with the spacedyeing process.

Other objects and advantages of this invention will appear in further detail hereinafter, and in the drawings, of which:

DESCRIPTION OF PREFERRED EMBODIMENTS

Figure 1:
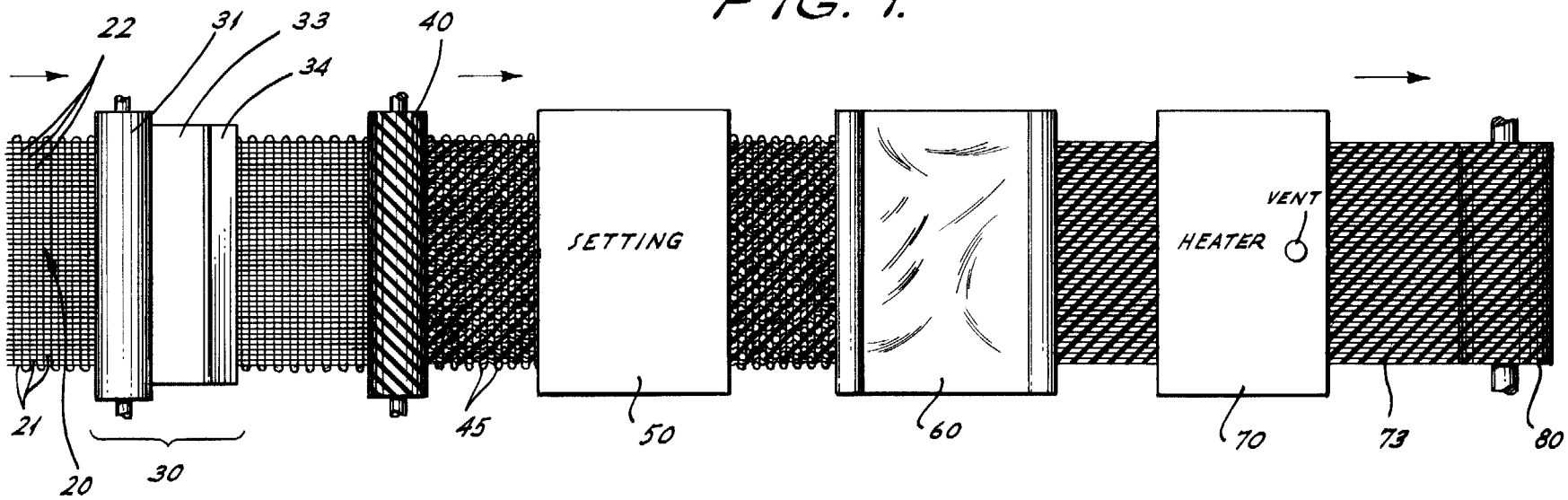
FIG. 1 is a view in plan illustrating one form of the new process as applied to a woven prefabric in accordance with this invention.

Although specific forms of the invention have been selected for illustration in the drawings, and the following description is drawn in specific terms for the purpose of describing those forms of the invention, this description is not intended to define or to limit the scope of the invention, which is defined in the appended claims.

Referring now to the drawings, FIG. 1 shows a woven prefabric 20, having a plurality of warps 21 composed of nylon, acrylic fibers, polypropylene or any other yarn which is intended to become the tufts in a tufted pile carpet, for example. The number 22 designates a sacrificial filling thread which is loosely woven with the warp yarns 21, at a spacing which is close enough to maintain the integrity of the prefabric as a fabric, and to keep the warp threads 21 parallel.

Figure 2:
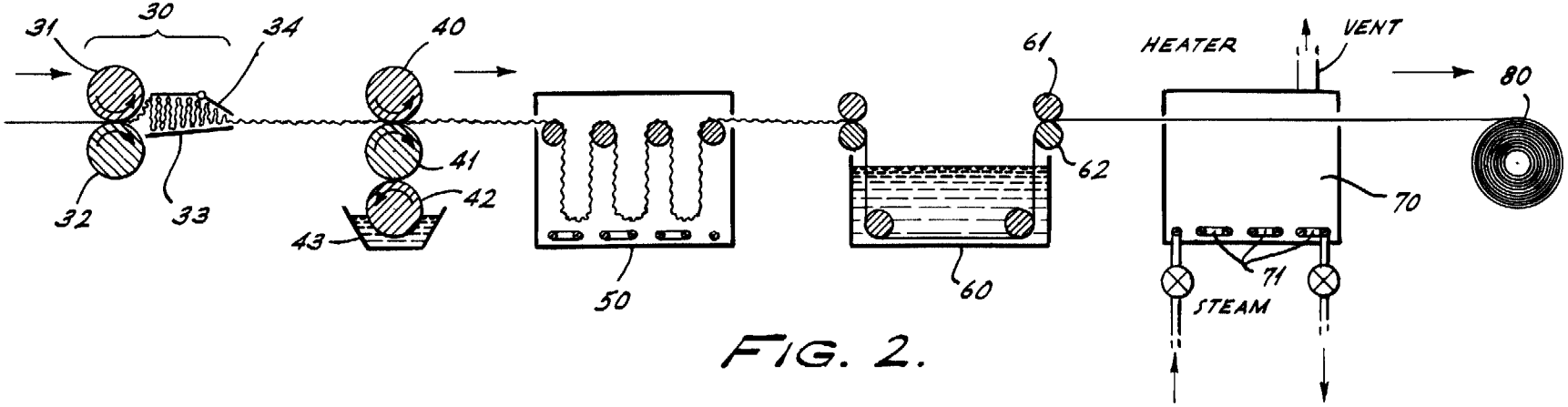
FIG. 2 is a view in side elevation corresponding to FIG. 1.

As shown in FIGS. 1 and 2, the woven prefabric containing the sacrificial threads 22 proceeds in a downstream direction as indicated by the arrow in the drawings, into a stuffer box crimper comprehensively designated by the number 30. This crimper includes a pair of feed rolls 31, 32 which nip and compress the prefabric 20 into a stuffer chamber 33 having a weighted or spring-urged outlet gate 34, which keeps the compression upon the prefabric within the chamber 33 and causes the warp yarns 21 to buckle and fold upon themselves in order to produce a multiplicity of V-shaped crimps, all in known manner, in order to provide bulk or "loft" for the yarns 21.

The crimped prefabric 20 then proceeds further in a downstream direction and passes between a pair of spacedyeing rolls 40, 41, the roll 41 being shown in FIG. 2 as being in running contact with an offset roll 42 which runs submerged in a dye resevoir 43. One or both of the rolls 40, 41 is provided with a specially shaped surface pattern, such as the striped pattern shown in FIG. 1 on the upper roll 40, for printing stripes upon the prefabric as it passes through between the printing rolls. This step of spacedyeing is known in and of itself in connection with knitted prefabrics, for example, wherein the prefabrics are all composed of the same yarn. In this case, the sacrificial filling yarns are also subjected to spacedyeing but the important feature of the spacedyeing step of the process according to this invention is that it provides a series of spaced colorations 45 upon the warp yarns 21, as indicated in FIG. 1. This provides the highly desirable spaced colorations in the final warp yarn product, as will further become apparent hereinafter.

Following the spacedyeing step, the prefabric 20 is conducted through a heat-setting chamber 50, which performs the dual purpose of heat-setting the dye that was applied in the spacedyeing step and also heat relaxing the crimp that was produced in the crimper 30. This beneficially develops the crimp, producing a much bulkier or loftier yarn than would otherwise be produced, and greatly enhances the value of the warp yarns for their ultimate use in tufted carpet products.

The heat-set prefabric 20 is conducted in a downstream direction into a tank 60 which contains a dilute solution of a chemical which, when concentrated, has sufficient strength to attack and destroy the sacrificial filling yarn 22 in its entirety. The solution contained within the container 60 is, however, dilute, and the prefabric 20 remains intact at this stage of the process.

It will be appreciated that various types of yarns may be used as the sacrificial filling yarns, and that correspondingly various types of solutions may be used in the tank 60. It is important to observe, however, that the solution used in the tank 60 is a dilute solution and does not attack the sacrificial filling yarns 22 to a significant degree at this point in the process.

The prefabric 22, after passing out between the nip rolls 61, 62 of the tank 60, passes into an autoclave 70 which is steam heated using serpentine pipes 71, which provide a high temperature in the autoclave. In the autoclave 70, the prefabric, and particularly the sacrificial filling yarn 22 thereof, is gradually subjected to a heating and drying operation, which gradually concentrates the acid or other chemical in which the prefabric 20 has been immersed, until it ultimately reaches such a high degree of concentration that it attacks and destroys the sacrificial filling yarn 22 within the autoclave 70. This completely liberates the warp yarns 21, 21 from each other while still maintaining them in a closely arranged parallel relationship, as shown at 73 in FIG. 1. In such a relationship, it is very convenient to wind the yarns up on a warp beam 80 or the like, in which condition they are ideally adapted for utilization as a warp of feed yarns for a wide variety of textile uses. They may be used as feed yarns for a typical conventional carpet tufting machine, for example.

Indeed, knowing the exact number of warp yarns which are used in a particular carpet tufting machine, or in a portion thereof, it is now possible to utilize exactly the same number of warp yarns in the prefabric 20, so that they will correspond exactly. Further, knowing of a predetermined design that is desired to be applied to the finished carpet, it is now possible to prearrange the design of one or more sets of spacedyeing rolls 40, 41, in order to pre-apply the specific desired design at any given point along the length of the warp yarns contained in the prefabric 20. Since the yarns are all kept in a known and exact relationship to each other, with each portion of the length of any given warp yarn retained in the same relative position with respect to similar lengths of adjacent warp yarns contained in the prefabric 20 and wound up upon the beam 80, it is quite possible to provide predetermined designs of color, color spacings and other design parameters, in order to produce a predetermined design in the final carpet product.

Figure 3:
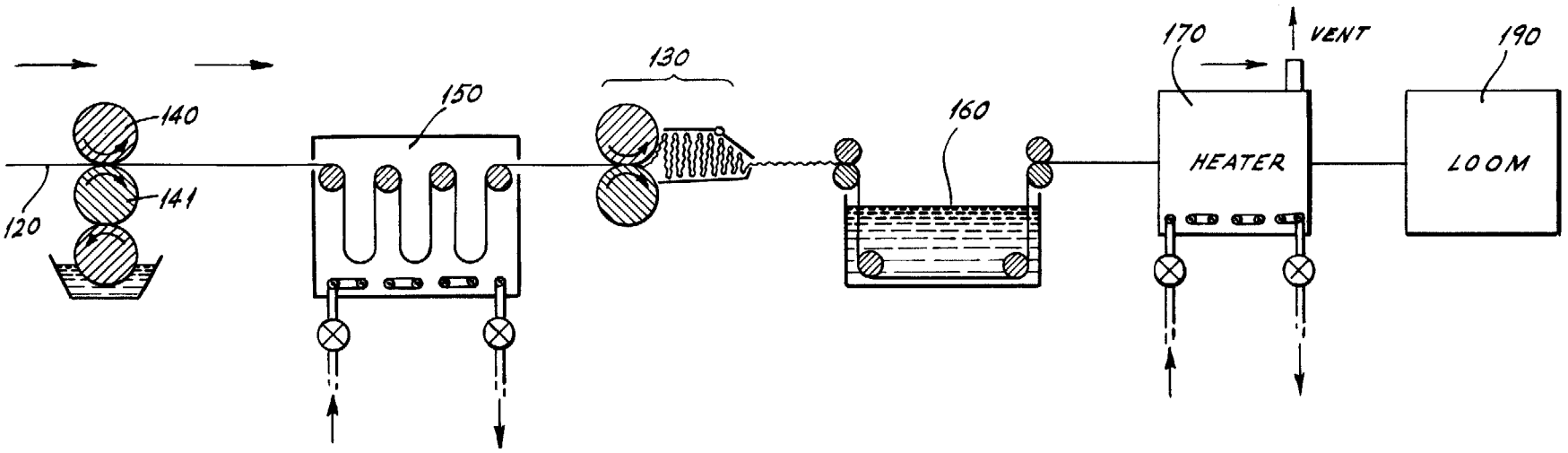
FIGS. 3 and 4 represent two alternative embodiments of the method of this invention.

Turning now to FIG. 3, this figure shows schematically an alternative form of apparatus and method in accordance with this invention. The prefabric 120 is passed through the spacedyeing rollers 140, 141 and then passes through a heat-setting chamber 150, which is similar to the heat-setting chamber described in FIGS. 1 and 2 of the drawings. Following heat-setting, the prefabric is then crimped in a crimper 130, after which it is passed through the bath 160 of a dilute chemical which when concentrated will attack and destroy the sacrificial filling yarn, and then passes through the autoclave 170 and is fed directly into a carpet tufting loom 190. As previously stated, the orderly and precise arrangement of the warp yarns relative to one another provides them in a condition which is ideal for feeding directly into a carpet tufting loom, or into a section thereof, without going through the burdensome and costly processes of winding, unwinding, etc.

It is important in accordance with this invention to heat-set the spacedyed prefabric after it has been spacedyed and before it is immersed into the solution of the warp destructive liquid. Otherwise, the warp destructive liquid tends to dissolve, leach or remove some of the dye from the spacedyed portions of the warp yarns, which is harmful to the final warp yarn product.

It is, of course, possible, as another alternative, to crimp each warp yarn individually, using single or multiple end crimping processes which are known per se, and to then use the already-crimped yarns as warps in the weaving process for weaving the prefabric 30. In such a circumstance, it is of course unnecessary to crimp the prefabric itself, since the sacrificial fillings are intended to be ultimately destroyed and it is immaterial whether they are crimped or not.

Figure 4:
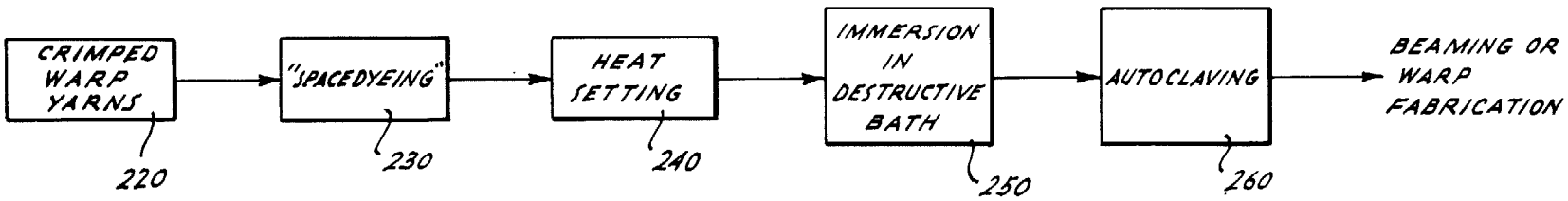

FIG. 4 shows such a process, in which crimped warp yarns 220 are individually fed into a loom (not shown) and are woven with the sacrificial filling yarn, followed by spacedyeing at 230, heat-setting the dye at 240, immersion in a destructive bath 250 which is a dilute solution of a material which, when concentrated, will attack the sacrificial filling yarns, followed by autoclaving at 260 in which gradual distillation and concentration of the destructive chemical takes place, with ultimate attack and destruction of the sacrificial filling yarns in the autoclaving step, followed by beaming or warp fabrication.

It will be appreciated that various other sequences of steps of the method may be practiced without departing from the scope of this invention. In any event, it is important that the dye be heat-set, and that the attacking chemical be one which is utilized in dilute form, but which is gradually concentrated in an autoclave or the like, until it finally reaches a terminal concentration which is sufficiently high to attack and destroy all or selected portions of the sacrificial filling yarn.

The advantages of this invention will now become fully apparent. In this invention, it is a simple matter to provide a multiplicity of yarns in warp form, to process them throughout the process as a warp, and to produce a multiplicity of spacedyed yarns having precisely the desired predetermined pattern for introduction into a tufted carpet. Indeed, even the crimping process may be conducted with the yarns arranged as a multiplicity of parallel yarns in the form of a warp, and they may pass through the crimping chamber in exactly that formation, following which they may be fed as a warp into a loom, woven loosely with the sacrificial filling yarn, and conducted as a prefabric in the manner heretofore described in detail. This is extremely advantageous from the point of view of productivity, because great productivity can be achieved by using a very large number of warps, such as 100, 200, or even 500 warps, all in a common process. Heretofore, as is well known, it has been the common practice to provide a prefabric having only a single end, and this has imposed considerable limitations with respect to productivity.

As stated, it is also an important advantage of this invention that predetermined patterns may be provided and correlated with the desired patterns in the final carpet product, since all of the warp yarns in the spacedyeing process according to this invention can be provided with predetermined patterns which can readily be matched up with the desired patterns of the final carpet product.

The cost of the sacrificial yarns can, of course, be considerably reduced by spacing them rather widely and loosely with respect to each other. It is only necessary that the integrity of the arrangement of the warp yarns be maintained throughout the process, and it is of course clear that the smaller the amounts of sacrificial filling yarns that are used, the smaller the amounts of attacking chemicals that will be required.

Although this invention has been described with reference to certain specific forms, and with reference to certain sequences of steps of the method, it will be appreciated that many other variations may be made without departing from the spirit and scope of this invention, which is defined in the appended claims.

I claim:

1. In a method of making a multiplicity of warps composed of a plurality of substantially parallel yarns for use in making carpets of a preselected pattern, the steps which comprise:

a. forming the yarns into warps;

b. weaving each of said warps with a sacrificial filling yarn to produce woven prefabrics, said sacrificial yarn being subject to decomposition or dissolution in a concentrated solution of a chemical;

c. forming a multiplicity of crimps in each of said prefabrics;

d. dyeing each of said woven prefabrics with predetermined patterns that are correlated with the desired pattern of the final carpet product in different colors in localized areas so that the localized areas along the lengths of the yarn are dyed in different colors, heat setting each prefabric after dyeing;

e. intimately contacting each prefabric with a dilute aqueous solution of said predetermined chemical;

f. heating and drying each prefabric so as to concentrate said solution to substantially decompose or dissolve said filling yarn without substantially attacking said warp yarns or said dye, completing the drying of said yarns;

g. taking up each of the resulting selectively locally dyed warp yarns as a warp;

h. matching up the warps into the desired pattern of the final product, and i. feeding each warp resulting into a fabricating machine to form the final carpet product with the preselected pattern.

2. The method defined in claim 1, wherein said step (g) comprises warp beaming.

3. The method defined in claim 1, wherein each prefabric is stuffer crimped with the warp yarns passing through a nip between crimping rolls, and with the filling yarn arranged substantially axially of said crimping rolls.

* * * * *